US006422563B1

(12) United States Patent
Fairchild et al.

(10) Patent No.: US 6,422,563 B1
(45) Date of Patent: Jul. 23, 2002

(54) METHOD OF PLAYING A DICE BETTING GAME AND A PLAYING BOARD THEREFOR

(76) Inventors: Andrew Fairchild; Ilene Fairchild, both of 12 Samuel St., Nesconset, NY (US) 11767

( * ) Notice: Subject to any disclaimer, the term of this patent is extended or adjusted under 35 U.S.C. 154(b) by 1 days.

(21) Appl. No.: 09/691,707

(22) Filed: Oct. 18, 2000

(51) Int. Cl.[7] ..... A63F 3/00

(52) U.S. Cl. ..... 273/274; 273/309; 463/16; 463/12

(58) Field of Search ..... 463/9, 10, 11, 463/12, 13, 16; 273/274, 292, 146, 309, 287, 138 R

(56) References Cited

U.S. PATENT DOCUMENTS 4,247,114 A * 1/1981 Carroll
4,312,508 A * 1/1982 Wood
4,334,685 A * 6/1982 Robbins et al.
4,635,938 A * 1/1987 Gray
4,688,803 A * 8/1987 Ollington
5,133,559 A * 7/1992 Page
5,265,881 A * 11/1993 Doherty
5,308,081 A 5/1994 Bartle
5,413,351 A * 5/1995 Franklin
5,513,850 A * 5/1996 Vancura
5,513,851 A * 5/1996 Harris
5,542,671 A * 8/1996 Stewart
5,573,248 A * 11/1996 Parra et al.
5,695,193 A 12/1997 Cheung
5,791,651 A * 8/1998 Bryant
5,879,006 A * 3/1999 Bowling
5,997,000 A * 12/1999 Nakano et al.
6,062,563 A * 5/2000 de Keller
6,120,377 A * 9/2000 McGinnis, Sr. et al.

OTHER PUBLICATIONS

Scarne's New Complete Guide to Gambling, pp. 505–513, 337–341, 1961, 1974.*

* cited by examiner

*Primary Examiner*—Michael O'Neill

(57) ABSTRACT

This invention relates to a method of playing a betting game. The game contains three dice for each the player and the dealer, betting tokens, at least one player, a dealer and a playing board. In addition, the present invention provides a playing board having various betting areas in which the players place their wagers. The object of the game is for the player to obtain the highest roll. A roll of a 1 and a 2 being the highest, followed by 6:6, 5:5, 4:4, 3:3, 2:2, and 1:1.

6 Claims, 2 Drawing Sheets

METHOD OF PLAYING A DICE BETTING GAME AND A PLAYING BOARD THEREFOR

BACKGROUND OF THE INVENTION

1. Field of the Invention

This invention relates to a method of playing a betting game using three dice and a board for playing the same.

2. The Prior Art

Various types of casino betting games, using three dice, and having game boards are known. Typically these games are used in a casino setting consisting of at least one player and a dealer. U.S. Pat. No. 5,308,081 to Bartle discloses a method of playing a three dice betting game.

In this invention, the players are provided with a playing board, betting tokens and dice. The betting surface has three types of betting zones. The first zone represents the result obtainable from the throw of one die. The second zone represents the result obtained from the throw of two dice. The third is the result from throwing the three dice. The player places bets in the respective zones before each die is thrown.

U.S. Pat. No. 5,695,193 to Cheung discloses a method of playing a dice game. In this case, the object of the game is to roll a combination containing the highest pair and the highest third die roll.

Prior games contain complicated rules and have complex playing boards. Players tend to enjoy simple games that they can quickly understand how to play and know what their odds are. However, a game still needs to provide the excitement of current casino games.

SUMMARY OF THE INVENTION

Therefore, it is an object of the present invention to provide a game having the excitement of craps and the simplicity of blackjack.

It is another object of the present invention to provide a method of playing a betting game that is easy to learn and follow.

A further object is to provide a playing board that is simple to understand and use.

These and other objects are accomplished by providing a method of playing a betting game containing three dice for each the player and the dealer, betting tokens, at least one player, a dealer and a playing board. The playing board is provided with various betting areas on which the players place their wagers. The object of the game is for the player to obtain the highest roll. A roll of a 1 and a 2 being the highest, followed by 6:6, 5:5, 4:4, 3:3, 2:2, and 1:1. A roll of a 1 and a 2 is considered an "A.C. Deuce", this being the name and object of the game.

The first step is for the players to choose whether they want to bet on the player or the dealer. At this time, the players place their wager on the dealer or the player area. The players may also optionally choose to place a player second wager. The players can choose to wager on a field bet provided on the playing board. These field bets are described in greater detail below. The various bets pay out at certain odds. One player at a time plays against the dealer, the next player is given a turn when the current player loses his roll.

BRIEF DESCRIPTION OF THE DRAWINGS

Other objects and features of the present invention will become apparent from the following detailed description considered in connection with the accompanying drawings.

It is to be understood, however, that the drawings are designed as an illustration only and not as a definition of the limits of the invention.

In the drawings, wherein similar reference characters denote similar elements throughout the several views:

FIG. 1 shows the playing board according to the invention; and

FIG. 2 shows numerous playing boards on a casino table setting.

DETAILED DESCRIPTION OF THE PREFERRED EMBODIMENT

Figure 1:
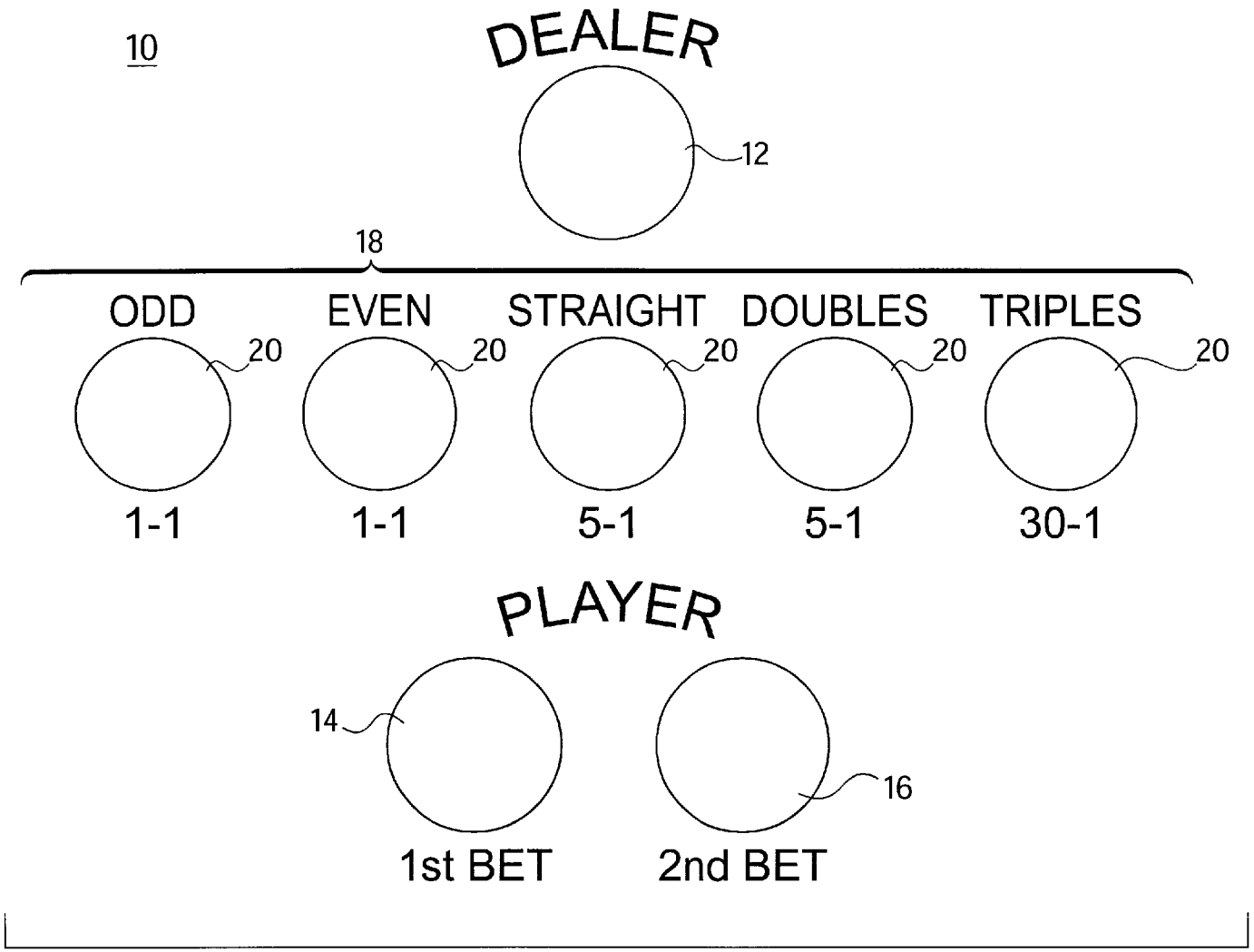

Referring now in detail to the drawings and, in particular, FIG. 1 there is shown a playing board 10. Board 10 is provided with an area 12 for placing tokens on a dealer wager, an area 14 for placing tokens on a player first wager, an area 16 for placing tokens on a player second wager, and an area 18 for placing tokens on field wagers. Field wager area 18 contains various options 20 that depend on the roll of the dice. For example, the player can choose the sum of the first two dice rolled being equal to an odd number, the sum of the dice being equal to an even number, or the roll containing doubles. A field bet may also be placed on the roll of the three dice resulting in a straight or triples. In a preferred embodiment, odds are placed below options 20 to inform the players of the pay out amount. In addition, it may be indicated on board 10 that the field bets result from the roll of the first two dice or the roll of the three dice.

The method of playing the game of the present invention is as follows: The player rolls two dice, then the dealer rolls two dice. In a preferred method, each set of dice is covered with a lucite box, after the dice are thrown, to prevent the dice from shifting. The object of the game is to roll a 1 and a 2. This is considered an "A.C. Deuce". If the player rolls a 1 and a 2 then all players who bet on the player to win is paid 3 to 2 odds, for example, and all field bets are pulled. However, if a player wagered on the player odd field bet, then this results in a return of the bet with no pay out. If the dealer rolls a 1 and a 2, then all field bets are pulled and those players who bet on the dealer are paid 3 to 2 odds, for example. If players have wagered on a dealer odd field bet, the bet will be returned with no pay out. If both the dealer and the player roll a 1:2, then all field bets are pulled, except the odd field bet will be returned with no pay out. In this case, a third die is rolled to determine a push or player/dealer win.

If a 1 and a 2 are not rolled by either the player or the dealer, winners of field bets of doubles, odds or evens are determined, being pulled or paid. A third die will be rolled to determine the winner of player or dealer wagers and remaining two field bets. The winner is determined by the best two out of three dice. The highest roll wins, for instance 1:2 being the highest and doubles 6:6 is considered the next highest, then 5:5, 4:4, 3:3, 2:2 and 1:1. In the event the player and dealer roll the same result, the third die may determine the winner with a payout, or result in a push, having no payout.

After the first roll by the player and the dealer, the players have the option of taking down their player second wager. The current player rolling the dice will continue to roll until he loses the roll to the dealer. At that time, the dice will pass to the next player.

Figure 2:
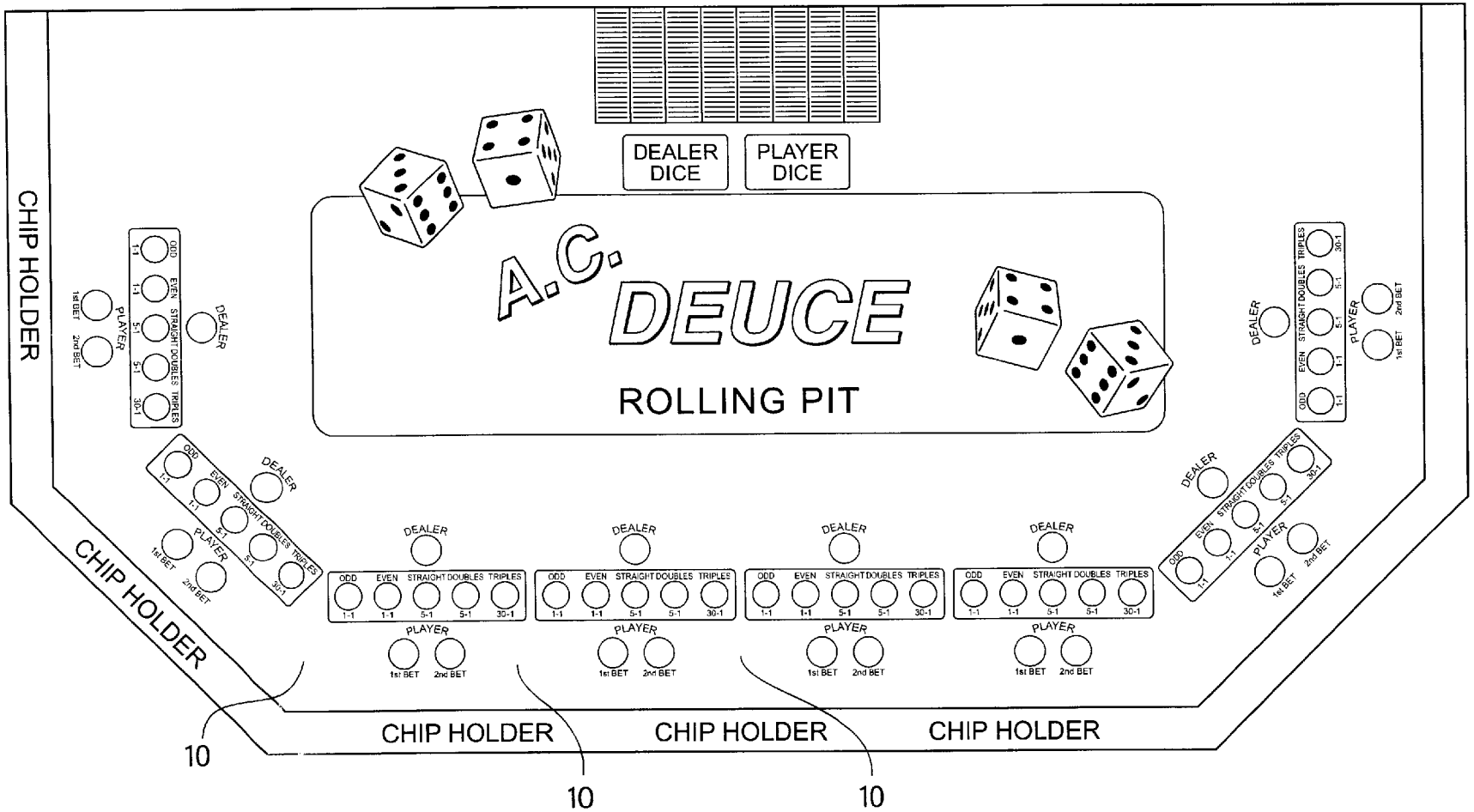

FIG. 2 shows an example of how the present game would appear on a casino table. A plurality of playing boards 10 would appear on the table, allowing numerous players to partake in the game.

Accordingly, while only a single embodiment of the present invention has been shown and described, it is obvious that many changes and modifications may be made thereunto without departing from the spirit and scope of the invention.

What is claimed is:

1. A method of playing a betting game having a dealer and a player comprising the steps of:

providing a playing board, betting tokens and three dice each to the player and the dealer;

placing a wager on a dealer wager area or a player first wager area;

choosing the option of a field bet and placing a wager thereon;

throwing a first roll comprising two of said three dice by the player and then the dealer;

determining any winners of said first roll of the;

paying any players who won on the result of said first throw; and throwing a second roll comprising the last of said three dice to determine any push of said first throw and any remaining field wagers, and paying out to winners;

wherein one player at a time plays against the dealer until that player loses the roll and the dice pass to the next player.

2. The method according to claim 1, further comprising the step of placing a lucite box over the dice after the first and second roll to protect the dice from shifting.

3. The method according to claim 2, further comprising the step of placing a second wager on a player second wager area after choosing to place a wager on the player and before any dice are rolled.

4. The method according to claim 3, wherein said player second wager is equal in dollar value to said player first wager.

5. The method according to claim 3, wherein said player second wager is less than said player first wager.

6. The method according to claim 3, further comprising the step of having an option of removing said player second wager after the player and the dealer throw said first roll.

* * * * *